US005370555A

United States Patent [19]

Smoravek

[11] Patent Number: 5,370,555

[45] Date of Patent: Dec. 6, 1994

[54] FILTER PLUG

[75] Inventor: Miroslav Smoravek, Seefeld, Germany

[73] Assignee: Siemens Aktiengesellschaft, Munich, Germany

[21] Appl. No.: 218,614

[22] Filed: Mar. 28, 1994

[51] Int. Cl.[5] ..... H01R 13/66

[52] U.S. Cl. ..... 439/620; 439/76

[58] Field of Search ..... 439/76, 620, 676

[56] References Cited

U.S. PATENT DOCUMENTS 5,018,990 3/1991 Sakamoto et al. ..... 439/620

FOREIGN PATENT DOCUMENTS 0124264 11/1984 European Pat. Off. .
8912173.2 3/1991 Germany .
9005597.2 10/1991 Germany .
0019686 1/1989 Japan ..... 439/620
0227976 9/1990 Japan ..... 439/620
90/06136 5/1991 WIPO .

*Primary Examiner*—Eugene F. Desmond
*Attorney, Agent, or Firm*—Herbert L. Lerner; Laurence A. Greenberg

[57] ABSTRACT

A filter plug includes lateral guides having insertion inclines for positioning and fixing a filter element, preferably a ferrite body, in a chamber of a pin bar body. The filter element is plugged onto plug pins being fixed by lateral spring elements which latch-in on the filter element and press the filter element against the chamber base. This creates a filter element attachment for simple installation which is integrated into the pin bar body, which is secure and insensitive to tolerances and which has no additional attachment devices.

18 Claims, 1 Drawing Sheet

FILTER PLUG

CROSS-REFERENCE TO RELATED APPLICATION

This application is a continuation of International application Ser. No. PCT/DE92/00717, filed Aug. 27, 1992.

BACKGROUND OF THE INVENTION

FIELD OF THE INVENTION

The invention relates to a filter plug including a pin bar connector body being composed of plastic and having a chamber being open towards at least one side, a number of parallel plug pins being disposed in a grid, entering the chamber from a rear side of the chamber through a base and emerging on the open side of the chamber, and at least one filter element, preferably a ferrite body, having holes formed therein matching the grid of the plug pins, being plugged onto the plug pins, and being held in the chamber without any play in axial direction of the plug pins, by means of at least one spring element being integrally formed on the pin bar body and composed of plastic. Such a filter plug is disclosed in German Petty Patent G 90 05 597.7.

In the case of such filter plugs, the ferrite bodies, which are plugged onto the plug pins together with bushing capacitors, are used for decoupling electromagnetic interference.

In order to be able to position the ferrite bodies, which have relatively large production-dependent tolerances, in the correct orientation and without play and to attach them securely, it is known and usual to bond the ferrite bodies into the pin bar body of the plug. However, that requires laborious manufacturing steps, wherein the curing of the adhesive in particular is linked with a time loss in mass production. In addition, in the case of some plastics which are used for pin bar bodies of a plug, bonded connections are not possible.

German Petty Patent G 89 12 173.2 discloses a filter plug having tubular ferrite bodies which are pressed against the base of a chamber by means of a plastic retaining strip. The retaining strip has pegs which are integrally formed in the grid of the plug pins, the ferrite bodies are plugged onto them and the chamber base is constructed with attachments which are in the form of truncated cones and are opposite the pegs. The retaining strip is constructed as a separate component and is attached to the pin bar body by means of lateral latching hooks and placed into recesses of the pin bar body.

In the case of the filter plug which is disclosed in German Petty Patent G 90 05 597.7, spring elements are provided which are integrally formed on the chamber base of the pin bar body, wherein a ferrite core which is plugged onto the plug pins and is inserted into the chamber is pressed into the chamber and held firmly there, against the force of the spring element, by means of a screening housing which is latched-in on the pin bar body. The ferrite core is thus not fixed in the final position on the shielding housing by means of an additional component, until the chamber has been closed.

SUMMARY OF THE INVENTION

It is accordingly an object of the invention to provide a filter plug, which overcomes the hereinafore-mentioned disadvantages of the heretofore-known devices of this general type, which has a filter-element attachment that is integrated in a pin bar body and which permits even simpler installation of a filter element, wherein the installation is at the same time more secure and is insensitive to tolerances.

With the foregoing and other objects in view there is provided, in accordance with the invention, a filter plug, comprising a plastic pin bar body including a chamber having at least one open side, a rear side, a base and lateral guides with insertion inclines; the pin bar body having a side wall running transversely to the chamber base and having at least one plastic spring element being integrally formed on the side wall; a number of parallel plug pins being disposed in a grid, entering the chamber from the rear side through the base and emerging toward the open side; at least one filter element, preferably a ferrite body, being guided by the insertion inclines in a given insertion direction into an insertion region, the at least one filter element having holes formed therein matching the grid of the plug pins and being plugged onto the plug pins, the at least one spring element being disposed alongside the filter element for holding the filter element in the chamber free of play in axial direction of the plug pins; the at least one spring element having an arm being resilient or springy transversely to the given insertion direction, the arm having ends being bent approximately at right angles in opposite directions, the ends of the arm including a bent end being formed on the side wall and a free bent end having a latching tab projecting into the insertion region for latching-in on the filter element with the filter element being inserted into the chamber and the filter element being plugged onto the plug pins and for pressing the latched-in filter element against the chamber base.

In the case of such a filter plug, the filter element is plugged into the lateral guides of the chamber and onto the plug pins and is latched in the chamber by means of a slight pressure. After the latching tab of the spring element has latched-in on the filter element, the filter element is already positioned without further measures and additional means, and is securely fixed in its position. The insertion inclines, which form an insertion channel that tapers in the insertion direction of the filter element, represent a simplification of installation and are disposed horizontally on the sides of the filter element in such a way that the filter element is already located in the correct orientation before operation of the spring element. A filter plug according to the invention is provided with a filter-element attachment which is integrally integrated in the pin bar body, so that the pin bar body and the filter element form a unit which can be prefabricated, although it still includes only two components and can be disposed and completely fitted on a base, for example a printed circuit board. The configuration of the spring element on the side of the filter element, between the filter element and a side wall of the pin bar body, interacts with the construction of the spring element having an arm which is springy transversely with respect to the insertion direction of the filter element, and has the advantage of permitting an adequate spring length to be achieved despite confined spatial conditions. A further advantage of this configuration is that the spring element is free of any moment in the load direction and has a certain amount of elasticity, which is significant for absorbing shock loads.

In accordance with another feature of the invention, the filter element is an integral ferrite body, which is in the form of a strip and is elongated.

In accordance with a further feature of the invention, with respect to the confined spatial conditions, the spring element extends between the filter element and the side wall of the pin bar body, in the longitudinal direction of the filter element.

In accordance with an added feature of the invention, the lateral guides are disposed at two mutually opposite ends of the filter element, so as to obtain adequate lateral guidance for the filter element.

In accordance with an additional feature of the invention, in each case the lateral guides are formed by two brackets which are correspondingly laterally spaced apart from one another by approximately the width of the filter element, which provides a particularly simple embodiment.

In accordance with still a further feature of the invention, the side wall of the pin bar body runs at right angles to the chamber base, and the arm of the spring element has a longitudinal direction extending parallel to the side wall.

In accordance with still an added feature of the invention, the filter element has ends and a length with a center, and the spring element is integrally formed on the side wall approximately in the center of the length of the filter element and latches-in on the filter element in the region of one of the ends of the filter element.

In accordance with yet another feature of the invention, particularly in the case of elongated filter elements, in order to provide adequately secure fixing of the filter element, two spring elements are provided which are integrally formed on the side wall, in mirror-image form with respect to one another and to the center of the length of the filter element, that latch-in on the filter element symmetrically.

In accordance with yet a further feature of the invention, the spring element is approximately rectangular in cross-section and stands upright with respect to the chamber base. This is advantageous both with respect to the spring effect of the spring element and because of the confined spatial conditions.

In accordance with yet an added feature of the invention, the latching tab of the spring element also stands upright between two plug pins. This then results in a particularly space-saving configuration of the filter-element attachment, with an optimum effect of the spring element.

In accordance with yet an additional feature of the invention, the insertion direction is selected to be in that direction of the filter element which has the smallest tolerances, so that the spring movement which is required for secure latching-in can be kept small.

In accordance with again another feature of the invention, the latching tab is constructed with an incline on its end surface, and an angle between this incline and the insertion direction is selected to be as small as possible. This is done in order to be able to keep the installation force, that is to say the force during insertion of a filter element into the chamber, as small as possible.

In accordance with again a further feature of the invention, the latching tab has a latching-in edge with an incline, the latching tab has a bearing surface on the filter element, and the incline and the bearing surface describe a free angle therebetween acting in a self-locking manner against unlatching of the filter element.

In accordance with again an added feature of the invention, the distance between the side wall of the pin bar body and the arm of the spring element is matched both to the required deflection and to the bending capability of the arm. This on one hand ensures a deflection which is necessary for latching-in and on the other hand prevents over-extension of the spring element.

In accordance with again an additional feature of the invention, the end of the arm formed on the side wall of the pin bar body defines connecting regions to the side wall and to the arm and has transition radii in both of the connecting regions.

In accordance with still another feature of the invention, the filter element has a step extending along its width over the entire length of the filter element, as seen in the insertion direction.

In accordance with a concomitant feature of the invention, the filter element has a pocket-shaped recess formed therein for the latching tab at locations at which the latching tab of the spring element latches-in.

Other features which are considered as characteristic for the invention are set forth in the appended claims.

Although the invention is illustrated and described herein as embodied in filter plug, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
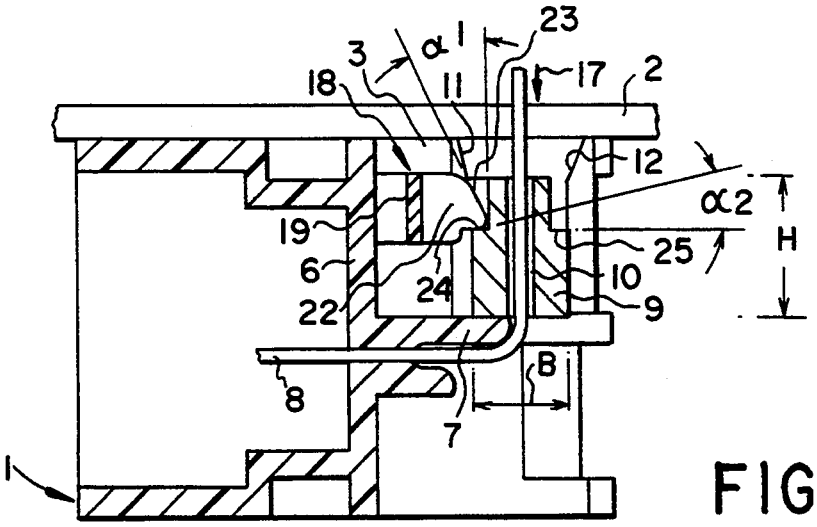
FIG. 2 is a fragmentary, longitudinal-sectional view taken along a line II—II of FIG. 1, in the direction of the arrows.

Referring now to the figures of the drawing in detail and first, particularly, to FIG. 2 thereof, there is seen a filter plug that has a plastic pin bar or connector body 1 which, on its right-hand outer side, has a chamber 3 that is open towards a printed circuit board 2 and towards the right-hand side. This chamber is formed by a front side part 4, a rear side part 5, a side wall 6 of the pin bar body 1 and a further side wall. The further side wall is integrally formed on the side wall 6, it projects at right angles approximately at the center of the height of the wall 6, and it forms a chamber base 7.

In addition, the filter plug also has a number of parallel plug pins 8 which are disposed in a grid, pass through the side wall 6, then run parallel under the chamber base 7, are bent away approximately at right angles, enter the chamber 3 from the rear side of the chamber through the chamber base and emerge on the side of the chamber which is open in the direction towards the printed circuit board 2. The filter plug is furthermore fitted with a filter element 9 which is constructed as an integral ferrite body that is in the form of a strip and has an elongated extent. The filter element 9 has holes 10 which are in the grid of the plug pins 8 and by means of which it is plugged onto the plug pins. In order to position the ferrite body 9 during insertion into the chamber 3 as well as for fixing in the inserted position, the chamber is constructed with respective lateral guides 15 and 16 which are provided with respective insertion inclines 11, 12 and 13, 14, are disposed at two mutually opposite ends of the elongated ferrite body 9 and in each case are formed by two brackets 15*a*, 15*b* and 16*a*, 16*b*, that engage around the corners of the ferrite body. These brackets are disposed opposite one another on the inside of the side parts 4 and 5 of the pin bar body 1. In each case the two brackets 15*a*, 15*b* and 16*a*, 16*b* are spaced apart from one another laterally by a distance being approximately equal to the width B of the ferrite body. The respective insertion inclines 11, 12 and 13, 14 of the guides 15, 16 in each case form an insertion channel which tapers in an insertion direction 17 of the ferrite body 9.

Figure 1:
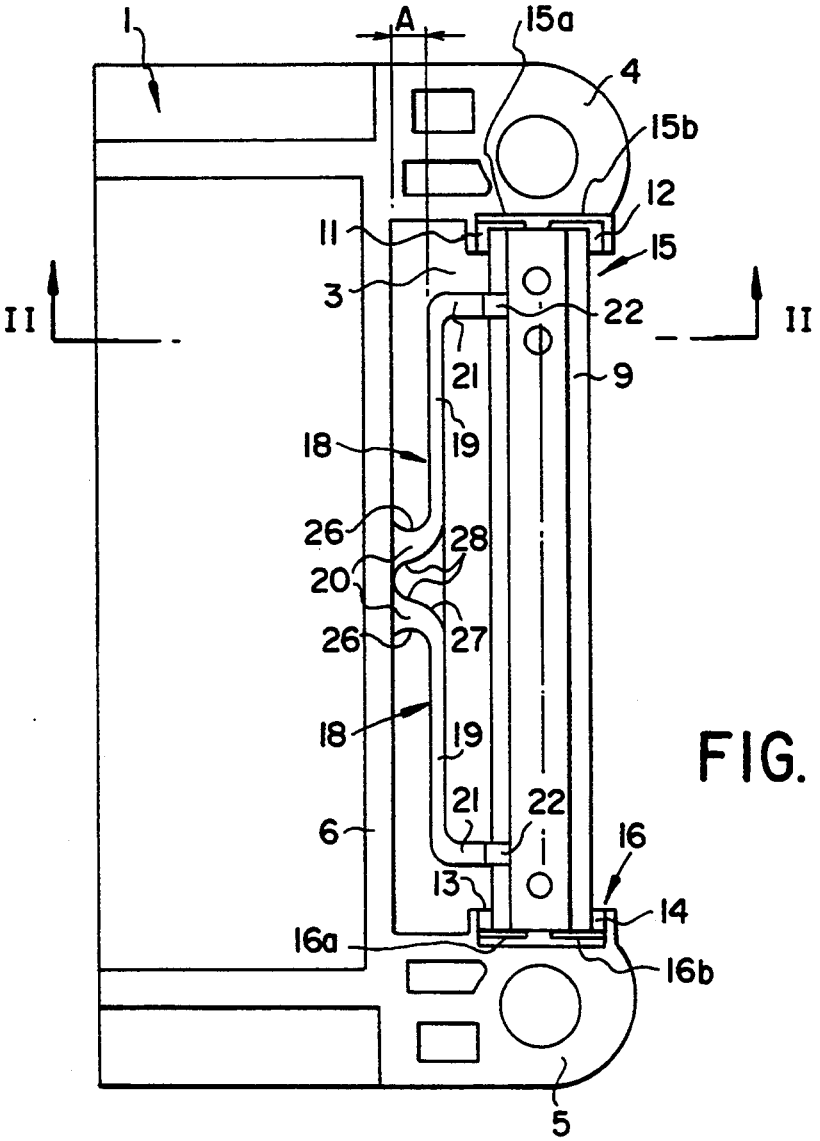
FIG. 1 is a diagrammatic plan view of a filter plug subregion, which includes a filter element.

In order to fix the ferrite body in the chamber 3, two spring elements 18 which are provided in this case extend from the sides of the ferrite body 9 between the ferrite body 9 and the side wall 6 in the longitudinal direction of the ferrite body and are integrally formed, for example by being injection molded, on the side wall 6 which is at right angles to the chamber base 7. The spring elements 18 are essentially formed by an arm 19 having a longitudinal direction which extends parallel to the side wall 6 and is bent away approximately at right angles in the opposite direction at its ends. One of the bent ends 20 is integrally formed on the side wall 6 approximately at the center of the length of the ferrite body 9, so that the arm 19 can spring transversely with respect to the insertion direction 17 of the ferrite body, while a free bent end 21 of the arm 19 is constructed with a latching tab 22 which projects into the insertion region of the ferrite body, latches-in on the ferrite body when the latter is inserted into the chamber and is plugged onto the plug pins 8, and is disposed and constructed in such a way that it presses the latched-in ferrite body 9 against the chamber base 7. As can be seen from FIG. 1, the two spring elements 18 are integrally formed on the side wall 6, in mirror-image form with respect to one another and to the center of the length of the ferrite body, and latch-in on the filter element symmetrically. The spring elements 18 are constructed to be approximately rectangular in cross-section and are disposed in such a way as to stand upright with respect to the chamber base 7, with the latching tab 22 of the spring elements, standing upright between two plug pins 8, latching-in on the ferrite body.

The insertion direction 17 is selected to be in the direction of the ferrite body 9 which has the smallest tolerances, that is to say in the direction of the height H of the ferrite body. The latching tabs 22 of the spring elements 18 are constructed with an incline 23 on their end surfaces. An angle $\alpha 1$ between this incline and the insertion direction 17 is selected to be as small as possible. A latching-in edge of the latching tab 22 is also constructed with an incline 24. A free angle $\alpha 2$ between this incline and the bearing surface of the latching tab on the ferrite body 9 is selected in such a way that the free angle acts in a self-locking manner against unlatching of the ferrite body. In order for the latching tab 22 to be able to latch-in on the ferrite body 9 at all, the ferrite body has a step 25 which extends over the entire length of the ferrite body, along its width B in the insertion direction 17. However, it is sufficient if the ferrite body is constructed with a pocket-shaped recess for the latching tab at those points at which a latching tab of a spring element latches-in. For convenience of illustration, in FIG. 2 the right side of ferrite body 9 illustrates step 25 usable as a latching surface as discussed if the ferrite body is reused end-for-end. The left side of ferrite body 9 in the same figure shows latching tab 22 engaged with a localized notch. A distance A between the side wall 6 of the pin bar body 1 and the arm 19 of the spring elements 18, which arm runs parallel thereto, is matched both to the necessary deflection and to the bending capability of the arm 19. The end 20 of the arm 19, which end is integrally formed on the side wall 6 of the pin bar body, is constructed with transition radii 26, 27, 28 both in the connecting region to the side wall 6 and in the connecting region to the arm 19.

In the case of the exemplary embodiment shown, the filter element 9 is of elongated construction and is fixed by means of two spring elements 18 which extend laterally and along the filter element. In the case of other filter elements, for example in the case of relatively small filter elements and/or in the case of filter elements having a different shape, adequate fixing of the filter element in the insertion direction may possibly also be achieved using a single spring element.

I claim:

1. A filter plug, comprising:

a plastic pin bar body including a chamber having at least one open side, a rear side, a base and lateral guides with insertion inclines;

said pin bar body having a side wall running transversely to said chamber base and having at least one plastic spring element being formed on said side wall;

a number of parallel plug pins being disposed in a grid, entering said chamber from said rear side through said base and emerging toward said open side;

at least one filter element being guided by said insertion inclines in a given insertion direction into an insertion region, said at least one filter element having holes formed therein in said grid of said plug pins and being plugged onto said plug pins, said at least one spring element being disposed alongside said filter element for holding said filter element in said chamber free of play in axial direction of said plug pins;

said at least one spring element having an arm being resilient transversely to said given insertion direction, said arm having ends being bent approximately at right angles in opposite directions, said ends of said arm including a bent end being formed on said side wall and a free bent end having a latching tab projecting into said insertion region for latching-in on said filter element with said filter element being inserted into said chamber and said filter element being plugged onto said plug pins and for pressing said latched-in filter element against said chamber base.

2. The filter plug according to claim 1, wherein said filter element is a one-piece, elongated, strip-shaped ferrite body.

3. The filter plug according to claim 2, wherein said spring element extends between said filter element and said side wall of said pin bar body, in longitudinal direction of said filter element.

4. The filter plug according to claim 1, wherein said filter element has two mutually opposite ends at which said lateral guides for said filter element are disposed.

5. The filter plug according to claim 4, wherein said filter element has a given width, and said lateral guides are each formed by respective brackets being correspondingly laterally spaced apart from one another by approximately said given width.

6. The filter plug according to claim 1, wherein said side wall of said pin bar body runs at right angles to said chamber base, and said arm of said spring element has a longitudinal direction extending parallel to said side wall.

7. The filter plug according to claim 1, wherein said filter element has ends and a length with a center, and said spring element is integrally formed on said side wall approximately in said center of said length of said filter element and latches-in on said filter element in the region of one of said ends of said filter element.

8. The filter plug according to claim 1, wherein said filter element has a length with a center, and including another spring element, said spring elements being integrally formed on said side wall a in mirror image with respect to one another and to said center of said length of said filter element, and said spring elements latch-in on said filter element symmetrically.

9. The filter plug according to claim 1, wherein said spring element is approximately rectangular in cross-section and stands upright with respect to said chamber base.

10. The filter plug according to claim 1, wherein said latching tab of said spring element stands upright between two of said plug pins.

11. The filter plug according to claim 1, wherein said insertion direction is a direction of said filter element having the smallest tolerances.

12. The filter plug according to claim 1, wherein said latching tab has an end surface being obliquely inclined relative to said insertion direction.

13. The filter plug according to claim 1, wherein said latching tab has a latching-in edge with an incline, said latching tab has a bearing surface on said filter element, and said incline and said bearing surface describe a free angle therebetween acting in a self-locking manner against unlatching of said filter element.

14. The filter plug according to claim 1, wherein said side wall of said pin bar body and said arm of said spring element are spaced apart by a distance being matched both to a necessary deflection and to a bending capability of said arm.

15. The filter plug according to claim 1, wherein said end of said arm formed on said side wall of said pin bar body defines connecting regions to said side wall and to said arm and has transition radii in both of said connecting regions.

16. The filter plug according to claim 1, wherein said filter element has a step extending along its width over the entire length of said filter element, as seen in the insertion direction.

17. The filter plug according to claim 1, wherein said filter element has a pocket-shaped recess formed therein for said latching tab at locations at which said latching tab of said spring element latches-in.

18. The filter plug according to claim 1, wherein said at least one filter element is a ferrite body.

* * * * *

UNITED STATES PATENT AND TRADEMARK OFFICE

CERTIFICATE OF CORRECTION

PATENT NO. : 5,370,555

DATED : December 6, 1994

INVENTOR(S) : Miroslav Smoravek

It is certified that error appears in the above-indentified patent and that said Letters Patent is hereby corrected as shown below:

On the title page, item (30), insert the following:

--Foreign Application Priority Data

Sep. 27, 1992 [DE] Germany..... 9112098 --.

Signed and Sealed this

Eighteenth Day of April, 1995

Bruce Lehman

*Attest:*

BRUCE LEHMAN

*Commissioner of Patents and Trademarks*

*Attesting Officer*